United States Patent [19]

Buse

[11] Patent Number: 5,045,026

[45] Date of Patent: Sep. 3, 1991

[54] SEALLESS PUMP ASSEMBLY APPARATUS

[75] Inventor: Frederic W. Buse, Allentown, Pa.

[73] Assignee: Ingersoll-Rand Company, Woodcliff Lake, N.J.

[21] Appl. No.: 538,660

[22] Filed: Jun. 15, 1990

[51] Int. Cl.[5] ..... H02N 13/00; F16D 27/01

[52] U.S. Cl. ..... 464/29; 464/170; 464/177; 464/185; 417/360; 417/423.14

[58] Field of Search ..... 464/29, 171, 170, 177, 464/185; 417/360, 423.14; 411/366, 424, 402, 999, 337; 403/167, 337, 119, 377, 16

[56] References Cited

U.S. PATENT DOCUMENTS

| | | | |
|---|---|---|---|
| 1,527,162 | 6/1921 | Alvord | 29/596 |
| 3,028,737 | 4/1962 | Rudisch | 464/29 |
| 3,131,462 | 5/1964 | Owings et al. | 29/607 |
| 4,032,806 | 6/1977 | Seely | 411/337 X |
| 4,439,096 | 3/1984 | Rockwood et al. | 417/360 X |
| 4,539,738 | 9/1985 | Antol et al. | 29/467 |
| 4,871,301 | 10/1989 | Buse | 417/420 |
| 4,897,023 | 1/1990 | Bingler | 417/360 X |

*Primary Examiner*—Lenard A. Footland
*Assistant Examiner*—Tony A. Gayoso
*Attorney, Agent, or Firm*—James R. Bell; David W. Tibbott

[57] ABSTRACT

A sealless pump including a casing carrying an inner rotor that carries magnets mounted on a shaft connected to the pump impeller. A thin can-shaped shell is mounted over the inner rotor and an outer frame is mounted over the shell. The outer frame includes an outer rotor carrying magnets adapted to couple magnetically with the inner rotor to drive the pump through the shell. A pair of guide posts are anchored to the casing and extend through holes in the outer frame for guiding the outer frame into and from an assembled position. Bolts are threaded into the guide posts and have suitable abutments for engaging and moving the outer frame between assembled and disassembled positions.

6 Claims, 3 Drawing Sheets

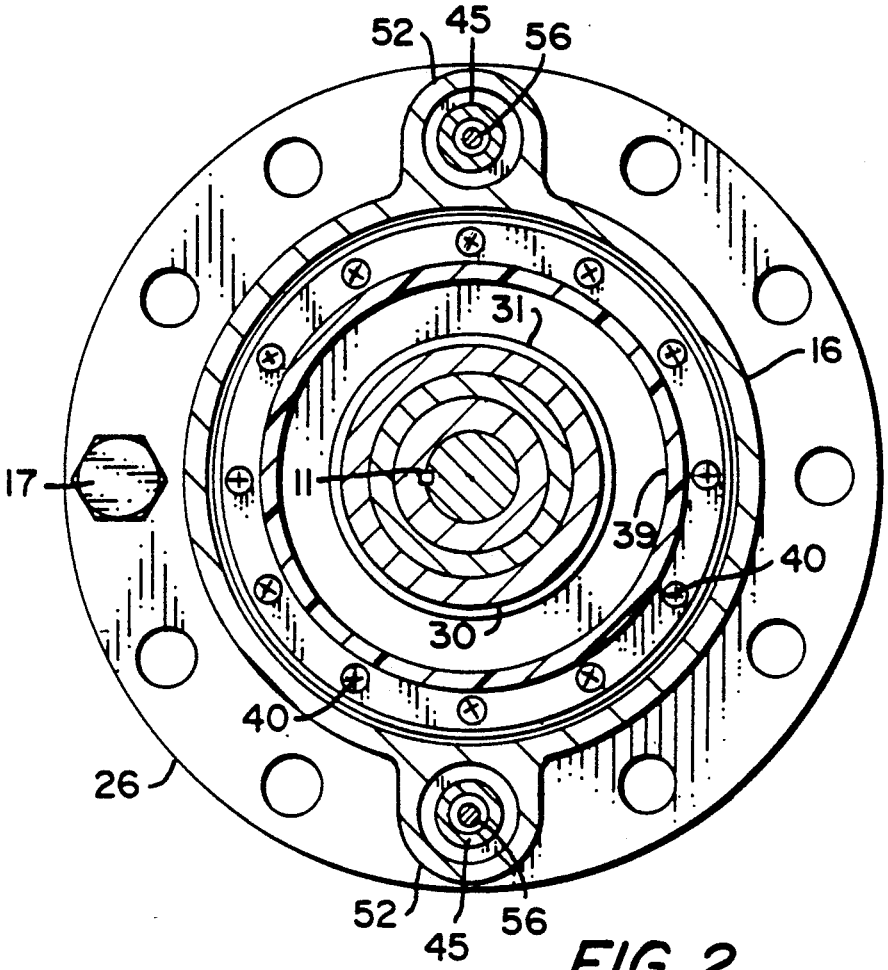
FIG. 2
FIG. 3
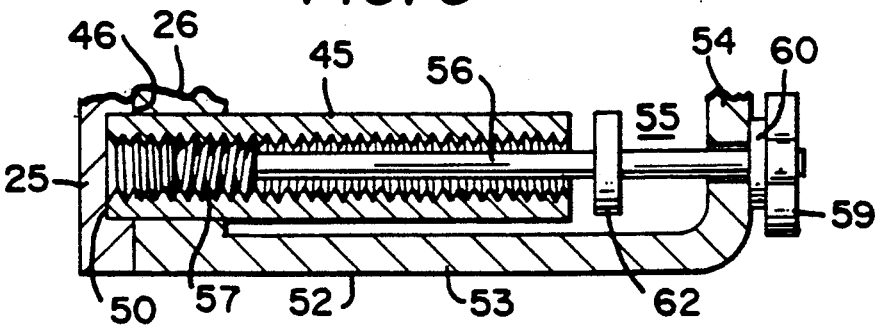

SEALLESS PUMP ASSEMBLY APPARATUS

BACKGROUND OF THE INVENTION

This invention relates generally to the art of centrifugal pumps and more particularly to the assembly of sealless pumps.

U.S. Pat. No. 4,871,301, issued Oct. 3, 1989, titled "Centrifugal Pump Bearing Arrangement", invented by me, relates to a sealless pump of the type having an internal rotor carrying a series of permanent magnets which are magnetically coupled with an external rotor carrying a second series of permanent magnets and driven by a driver such as a electric motor. The magnetic coupling eliminates shaft seals which have the risk of leaking; therefore, the pumped fluid can be contained in an envelope which does not contain openings for a rotor shaft or the like which are subject to leaking. As pumps of this type are made larger, the magnetic forces of the magnets become larger and in some cases large enough to cause great difficulty in assembling the magnetically coupled rotor devices without injury occurring to either the pump or to workmen assembling the pump. For example, in pumps of approximately 50 horsepower the axial forces on the magnetic rotors can be as large as 200 pounds.

The assembly of the outer or driving magnet rotor must be carried out with the rotor located centrally on the containment shell enclosing the inner magnet rotor and with a controlled axial movement of the outer magnet rotor into position over the inner magnet rotor. If the outer magnet rotor moves out of a central position, or moves axially in an uncontrolled manner, tremendous forces can pull it into abutment with other portions of the pump causing injury to either or both the pump and the workmen carrying out the assembly of the pump. This same problem exists in the field during disassembly or reassembly of the pump during a maintenance or repair procedure.

SUMMARY OF INVENTION

This invention covers an apparatus for enabling the outer rotor of the sealless pump to be easily assembled and disassembled from the containment shell of the pump without injury to either the pump or adjacent workmen. The invention covers an apparatus for guiding the outer magnet rotor and holding it in a centralized position as it is moved axially over the containment shell. In addition, the apparatus includes means for guiding and holding the outer rotor while it is moved axially in a disassembly direction. Further the apparatus includes means for forcing the outer rotor in both assembly and disassembly directions while holding it in a centralized position.

The invention is summarized in connection with a magnetically driven machine including a casing supporting an inner rotor carrying magnets, a separating shell mounted on the casing surrounding the inner rotor and an outer frame containing an outer rotor carrying magnets adapted to couple magnetically with the inner rotor for transmitting rotary torque through the shell. The invention includes a pair of guide members mounted on the casing and adapted to slide in cooperating openings in the outer frame for guiding the outer frame into and from an assembled position seated over the shell wherein the rotors are magnetically coupled for the transmission of rotary power, means for moving the outer frame into the assembled position seated over the shell, and means for moving the outer frame toward a disassembled position, both movements being carried out while the outer frame is guided by the guide members in a controlled manner along a defined path extending between the assembled and disassembled positions.

The foregoing and other aspects will become apparent from the following detailed description of the invention when considered in conjunction with the accompanying drawing figures. It is to be expressly understood, however, that the drawing figures are not intended as a definition of the invention but are for the purpose of illustration only.

BRIEF DESCRIPTION OF THE DRAWINGS

In the drawings:

FIG. 2 is a cross-section of FIG. 1 taken along line 2—2;

FIG. 3 is an enlarged portion of FIG. 1 showing a guide post and associated threaded bolt used for guiding and moving the outer frame into and out of an assembled position on the pump casing, and;

DESCRIPTION OF PREFERRED EMBODIMENT

Figure 1:
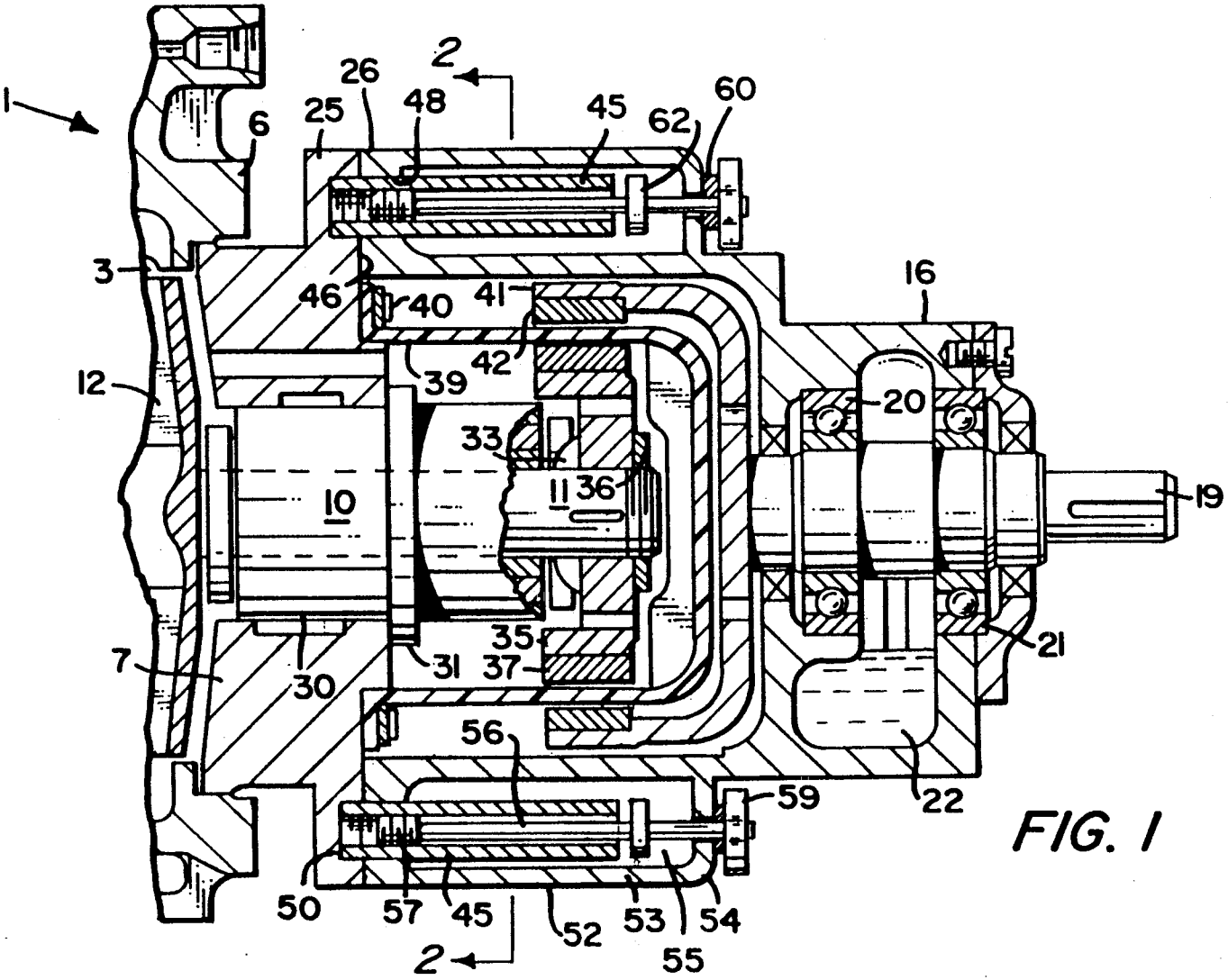
FIG. 1 is a cross-sectional view of the driven end of a sealless type of centrifugal pump taken along the rotary axis of the pump impeller shaft and illustrating an embodiment of the invention.
Figure 4:
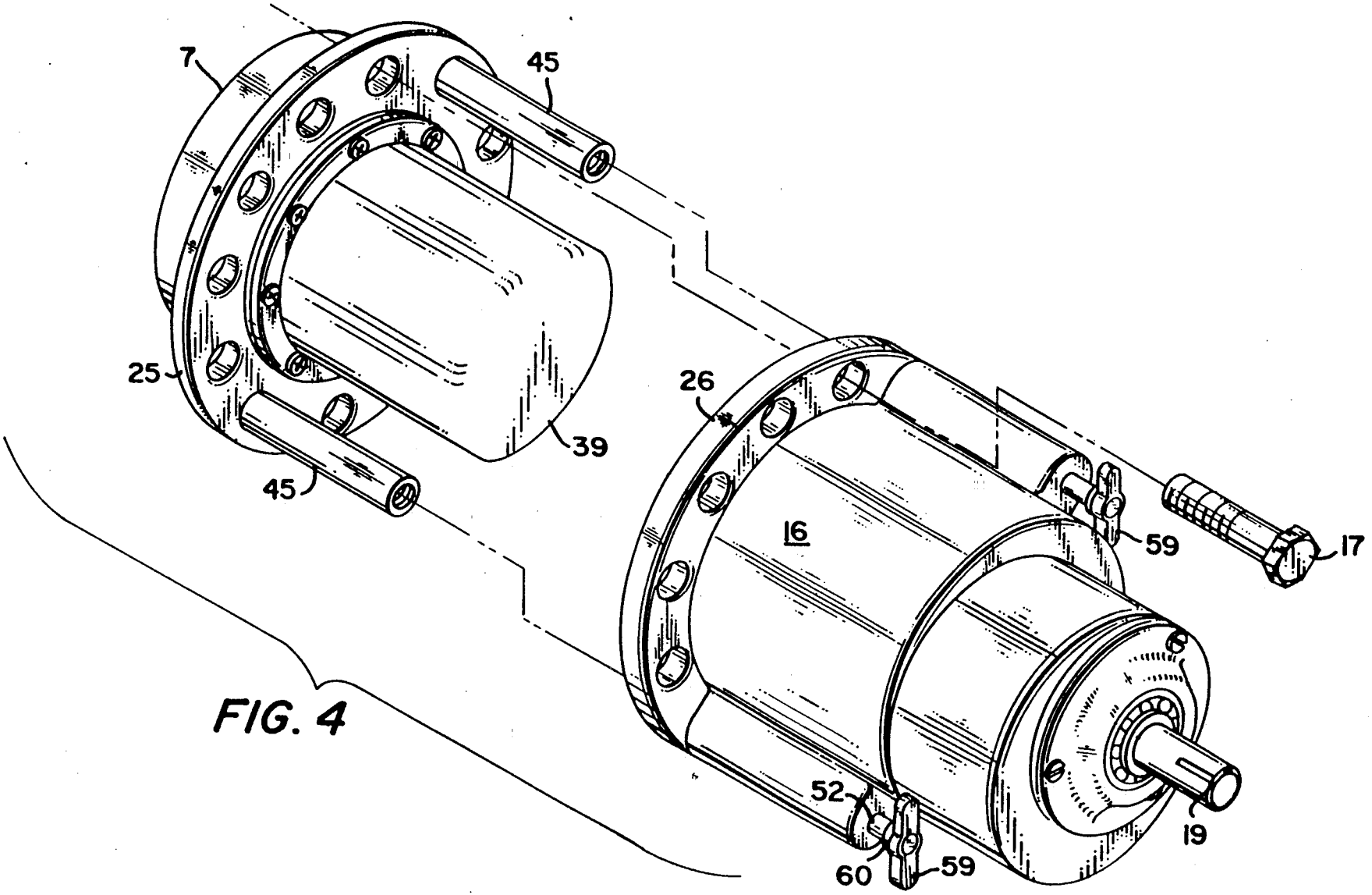
FIG. 4 is a perspective and exploded view of the portions of the pump shown in FIG. 1 illustrating the movement of the outer frame into an assembled position on the pump casing.

The sealless centrifugal pump shown in the drawings includes a pump casing 1 (shown partly in FIG. 1) enclosing a pumping chamber 3 surrounded by an annular flange 6 formed on the casing 1. The annular flange 6 is adapted to receive a casing cover 7 closing the pumping chamber 3 and circling a pump cartridge 10 containing a number of components including an axially extending shaft 11 carrying a semi-open pump impeller 12 rotating in the pumping chamber 3. Further details of this type of pump are disclosed in U.S. Pat. No. 4,871,301, mentioned earlier in this specification.

An outer frame 16 fits over the cartridge 10 and is attached to the casing 1 and casing cover 7 by a series of bolts 17 circling the outside of the flange 6. A drive shaft 19 is rotatively mounted in the outer frame 16 by a pair of axially spaced bearings 20 and 21 fixed in the frame 16 on the opposite sides of a bearing chamber 22 adapted to contain lubricant for the bearings 20 and 21. The outer end of the shaft 19 is adapted to be coupled to a driving motor (not shown) using a conventional coupling means.

The casing cover 7 is an annular member that seats in a recess in the casing 1 circling the pumping chamber 3 and has a rim 25 overlying the flange 6 with holes receiving the bolts 17. The annular rim 25 is sandwiched between the flange 6 and an annular flange 26 on the open end of the outer frame 16 with the bolts 17 serving to hold both the casing cover 7 and the outer frame 16 to the casing 1.

The cartridge 10 includes a cartridge body 30 which fits into the casing cover 7 and has an annular step 31 seating against the outer face of the casing cover 7 controlling the distance that the cartridge body 30 extends into the casing cover 7. The cartridge body 30 contains suitable journal bearings rotatably supporting the impeller shaft 11.

The rear end of the shaft 11 carries a thrust bearing 33, an inner magnet holder 35 keyed on the shaft 11 and a nut 36 threaded on the rear end of the shaft 11. The nut 36 locks all of the rotating components of the cartridge 10 in place on the shaft 11 in the cartridge body 30 extending through the journal bearings in the cartridge body 30.

The periphery of the inner magnet holder 35 carries a series of permanent magnets 37 which rotate closely about the interior of a relatively thin can-shaped shell 39 which fits over the magnet holder 35 and the other parts of the cartridge 10 and is fastened to the casing cover 7 by bolts 40. The outer frame 16 contains an outer magnet holder 41 attached to and rotating with the drive shaft 19 around the can-shaped shell 39 in close proximity thereto. The outer magnet holder 41 carries a series of permanent magnets 42 spaced around its interior which are magnetically linked to the magnets 37 on the inner magnet holder 35 for transmitting torque from the outer magnet holder 41 to the pump impeller shaft 11. Driving a pump impeller using magnets in this manner is well known in the art of sealless pumps.

Means is provided for guiding the outer frame 16 in an axially centered position over the inner magnet holder 35 during assembly of the outer frame 16 on the pump casing 1. A pair of diagonally located guide posts 45 are attached to the rear face 46 of the rim 25 on the casing cover 7 in a position wherein they extend parallel to each other and to the axis of shaft 11. A corresponding pair of holes 48 are provided in the flange 26 on the power frame 16 to slidably receive the guide posts 45. The holes 48 are dimensioned to snugly receive the guide posts 45 so that outer frame 16 is guided in a controlled manner as it slides on the guide posts 45. In assembling the outer frame 16 on the pump casing 1, the outer frame 16 is positioned with the guide posts 45 entering the holes 48 on the flange 26 and then moved axially toward the pump casing 3 with the walls of the holes 48 sliding on the guide posts 45, wherein the outer frame is maintained in a centered position on the casing cover and on the shell 39 during its movement into position seated on the rim 25 of the casing cover 7. The guide posts 45 are mounted on the rim 25 by being placed in sockets 50 drilled in the rim 25 and anchored therein by means such as welding or an interference fit wherein they cannot be easily removed.

Means is provided for moving the outer frame 16 in a controlled manner on the guide posts 45. Each guide post 45 is enclosed in a small housing 52 integrally formed on the outer frame 16 and having a side wall 53 extending rearwardly from the flange 26 to an end wall 54 which closes the interior of the chamber 55 housing the guide post 45 and extends inwardly at a right angle to the guide post 45 to join integrally with the remainder of the outer frame 16. This structure can be seen in FIGS. 1 and 2. Each guide post 45 is hollow and contains internal threads. A bolt 56 is threaded in each guide post 45 and extends rearwardly therefrom through an opening in the end wall 54 of the guide post housing 52. Each bolt 56 is threaded on its front end 57 and has a head 59 at its rear end formed in the shape of a tee-shaped handle, somewhat like a tee-shaped faucet handle, making it easily grasped and turned by a human hand. Alternately, the head 59 could be hexagonally shaped wherein it would require a wrench for turning.

Each bolt 56 carries a washer 60 located beneath the head 59 and adapted to bear on the outer surface of the end wall 54 of the guide post housing 52. After the outer frame 16 is located on the guide posts 45 the bolts 56 can be rotated in a tightening direction into the guide post with the washers 60 bearing on the end wall 54. As the bolts are rotated deeper into the guide posts 45 they will draw the outer frame 16 axially into position against the rim 25 of the casing cover 7.

Means is also provided for lifting the outer frame 16 away from the casing cover 7. Washer-like abutments 62 are fixed on the shanks of the bolts 56 at a location where each is spaced from the end wall 54 of the housing 52 when the outer frame 16 is in an assembled position and also spaced from the end of the guide post 45 in the same position. If it is desired to disassemble the outer frame 16 from the casing cover 7, the bolts 56 are rotated in the removal direction until the abutments 62 engage the inner faces of the housing end walls 54 wherein further movement of the bolts 56 will lift the outer frame 16 away from the casing cover 7 in a controlled manner while the outer frame 16 slides on the guide posts 45. The abutments 62 also serve to lock the bolts 56 in their housings 52 so that they cannot be easily lost or misplaced by careless workman.

While this invention has been illustrated and described in accordance with a preferred embodiment, it is recognized that variations and changes may be made therein without departing from the invention as set forth in the claims.

Having described the invention, what is claimed is:

1. In a magnetically driven machine including a casing supporting an inner rotor carrying magnets, a separating shell mounted on the casing surrounding the inner rotor and a outer frame containing an outer rotor carrying magnets adapted to couple magnetically with the inner rotor for transmitting rotary torque through the shell, wherein the invention comprises: a pair of guide members mounted on the casing and adapted to slide in cooperating openings in the outer frame for guiding the outer frame into and from an assembled position seated over the shell wherein the rotors are magnetically coupled for the transmission of rotary power, means for moving the outer frame into the assembled position seated over the shell, and means for moving the outer frame toward a disassembled position, both movements being carried out while the outer frame is guided by the guide members in a controlled manner along a defined path extending between the assembled and disassembled positions.

2. In the machine of claim 1 wherein: a guide member is threaded and the means for moving the outer frame into an assembled position is a threaded member cooperating with said threaded guide member.

3. In the machine of claim 2 wherein: the means for moving the outer frame into a disassembled position are threaded members cooperating with said guide members.

4. In the machine of claim 3 wherein: bolts are threaded into said guide members, extend through holes in the outer frame and engage surfaces on said outer frame to urge and move said outer frame toward the assembled position.

5. In the machine of claim 4 wherein: the bolts have surfaces that can engage corresponding surfaces on said outer frame to urge and move said outer frame toward the disassembled position.

6. In the machine of claim 5 wherein: the bolts are mounted on the outer frame in a manner preventing them from being readily separated from the outer frame.

* * * * *